United States Patent [19]

Benner

[11] 4,020,586

[45] May 3, 1977

[54] DOLL WITH ENVELOPE FOR PHOTO IMAGE FACE, AND HAIR CONCEALING ENVELOPE OPENING

[75] Inventor: Dorothy Benner, South Miami, Fla.

[73] Assignee: Picture Doll Company, Miami, Fla.

[22] Filed: Nov. 11, 1975

[21] Appl. No.: 631,173

Related U.S. Application Data

[63] Continuation-in-part of Ser. No. 542,514, Jan. 17, 1975, abandoned.

[52] U.S. Cl. ..... 46/164

[51] Int. Cl.[2] ..... A63H 3/36

[58] Field of Search ..... 46/164, 153, 116, 157; 40/10 B, 10 D; 35/58

[56] References Cited

UNITED STATES PATENTS

| | | | |
|---|---|---|---|
| 764,441 | 7/1904 | Engel | 46/35 UX |
| 1,995,518 | 3/1935 | Perry | 40/10 D |
| 2,199,049 | 4/1940 | Greenberg | 46/164 |
| 2,361,670 | 10/1944 | Whitehead | 40/10 D |
| 3,811,220 | 5/1974 | Glass et al. | 46/153 UX |

*Primary Examiner*—F. Barry Shay
*Attorney, Agent, or Firm*—Millen & White

[57] ABSTRACT

A doll having a pocket means in a face zone to receive a photographic likeness of a person to personalize the doll.

7 Claims, 3 Drawing Figures

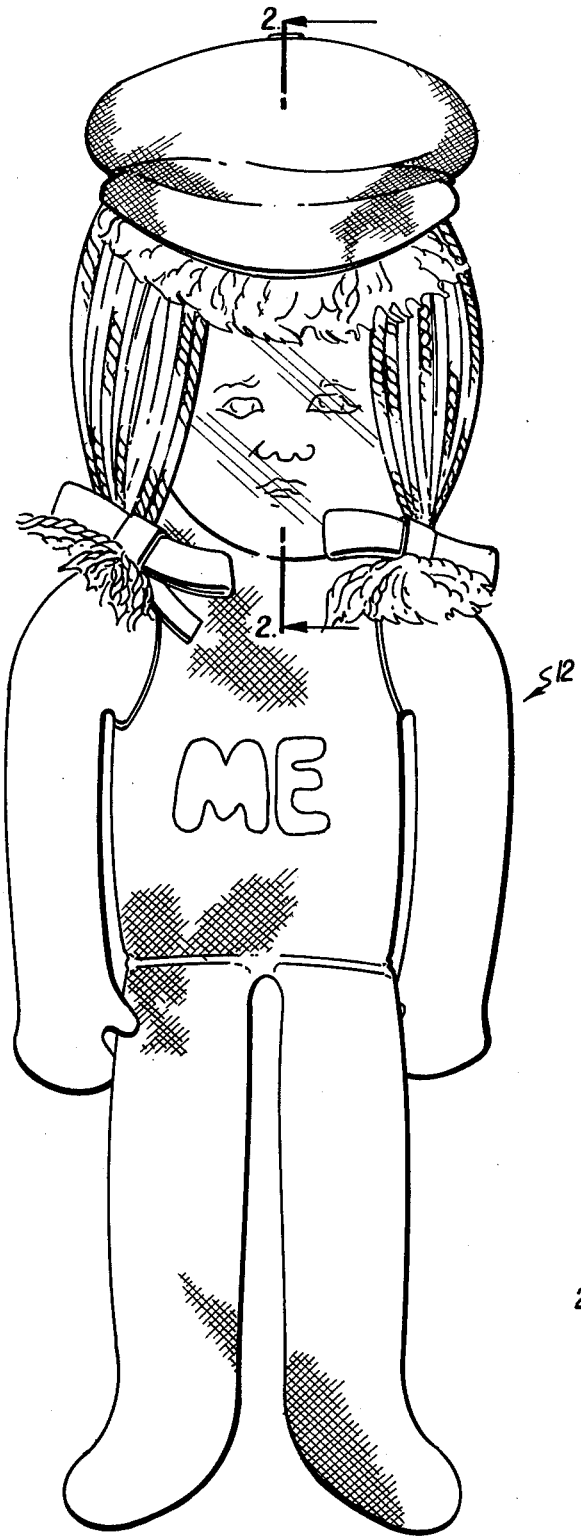
FIG. 1
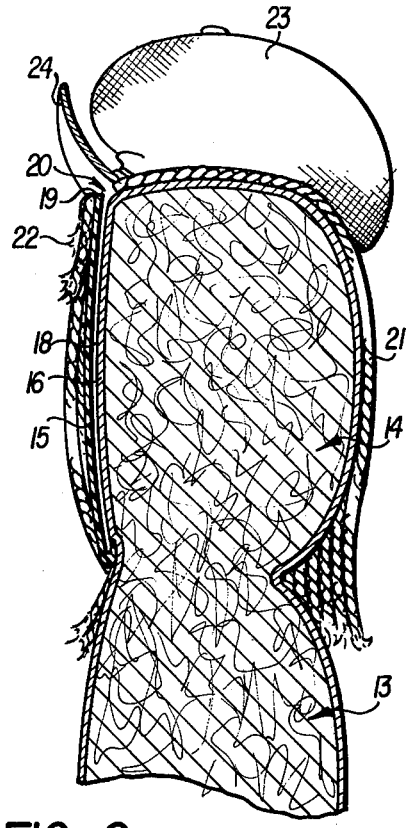
FIG. 2
FIG. 3
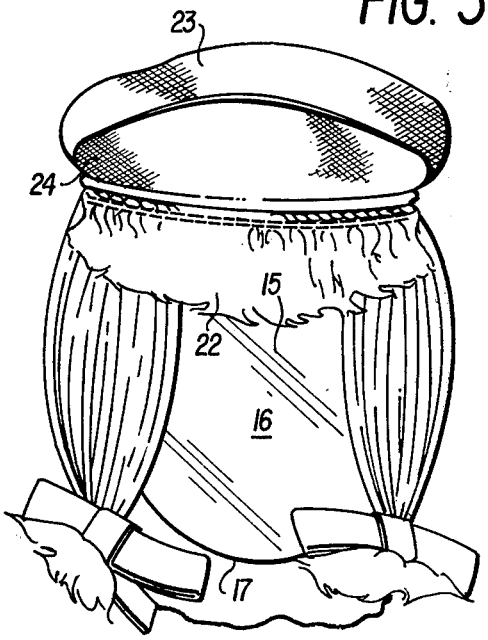

DOLL WITH ENVELOPE FOR PHOTO IMAGE FACE, AND HAIR CONCEALING ENVELOPE OPENING

This is a continuation-in-part of application Ser. No. 542,514, filed Jan. 17, 1975, now abandoned.

BACKGROUND OF THE INVENTION

This invention relates to toys, and, more particularly, to dolls including a pocket means to receive a photographic likeness of a person to make an interesting toy.

Many times children like to play with dolls which have a particular meaning, and this invention provides a pocket in a face zone of a doll which is adapted to be occupied by a photographic likeness of a person, such as the child himself.

It is known to provide a toy doll having a changeable facial image. See, for example, U. S. Pat. No. 2,199,049, issued to A. D. Greenberg. Such a prior art doll is limited by its failure to provide a protective envelope for the image disposed over the doll's facial region. Additionally, access may be had to the image receiving slot of such a doll only after displacing the doll's head covering, either in the form of a hat or a wig, prior to insertion or removal of such a facial image.

It is therefore an object of this invention to provide an improved construction for a doll to receive a photographic likeness in overlaying relation of the face zone which includes a transparent protective film in the form of a semi-oval envelope within which the photographic likeness is adapted to be retained.

An additional object of this invention is to provide such an improved construction which has a realistic apparance but which nevertheless facilitates easy insertion and removal of such photographic likenesses.

Upon study of the specification and appended claims, additional objects and advantages of this invention will become apparent to those skilled in the art.

SUMMARY OF THE INVENTION

Briefly, the above and other objects are attained in one aspect of the present invention by providing a toy doll comprising a body portion, and a head portion, said head portion including a face portion, a protective plastic, transparent film attached along its side and bottom edges only to said face portion to define a photo receiving envelope, the unattached upper edge of said film cooperating with said face portion to define a photo entry slot for said envelope, whereby a photographic image may be easily disposed in said envelope and protected therein.

DESCRIPTION OF THE DRAWINGS

FIG. 1 is a front elevation view of a doll constructed in accordance with this invention.

FIG. 2 is a view in cross section taken along the plane indicated by the section line 2—2 of FIG. 1.

FIG. 3 is a partial front elevation view of the doll of FIG. 1.

DESCRIPTION OF THE PREFERRED EMBODIMENT

Referring to the drawings, wherein like reference characters designate like or corresponding parts throughout the several view, a doll 12 includes a body 13 and a head 14.

A generally semi-oval shaped transparent film 15 is disposed over the facial portion 16 of the doll's head

14. The film 15, with its curved edge pointing downwardly, is fixedly attached along its curved periphery 17 to the facial portion 16 so that the film and doll body cooperate to define a photo receiving, transparent envelope 18 which positions and protects the photo disposed therein. The unattached, relatively straight top edge 19 of the film 15 cooperates with the doll head to define a photo entry slot 20 for the envelope 18.

A mass of thread- or yarn-like material 21 may be attached to the doll head 14 to simulate hair. A portion of the material 21 may be suspended from the film 15 proximate its straight edge 19 adjacent the photo entry slot 20 to simulate bangs 22. The remaining yarn-like material may then be attached to the doll's head 14 and/or to the film 15 proximate the sides of the doll's face.

Thus the film 15, in addition to its protective function, serves to support the hair-like material proximate to the photographic image to enhance the appearance of the doll. At the same time, the film 15 supports the material 21 away from the slot 14 to thus avoid inhibiting insertion or removal of photos into the envelope 13. In order to conceal the slot 20 and further enhance a realistic appearance on the part of the doll, a hat 23, with a foldable brim 24, is attached to the top of the doll's head 14. The brim 24 extends outwardly over the bangs 22 above the doll'facial portion. The hat 23 and bangs 22 thus cooperate to conceal the readily accessible slot 20.

The toy embodying this invention is thus advantageous in that it provides a realistically appearing doll carrying a readily insertable and changeable photographic image which is protected from the environment during use and yet is readily accessible when it is desired to remove and replace such an image.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A toy doll comprising a. a body portion; and b. a head portion, said head portion including i. a face portion, ii. a protective plastic, transparent film attached along its side and bottom edges only to said face portion to define a photo receiving envelope, the unattached upper edge of said film cooperating with said face portion to define a photo entry slot for said envelope, whereby a photographic image may be easily disposed in said envelope and protected therein; and iii. a mass of hair-like material disposed on said head portion and concealing said upper edge of said transparent film, the portion of said hair-like material concealing said upper edge being attached to the exterior surface of said film along said upper edge thereof.

2. A toy doll of claim 1 wherein said transparent film is semi-oval and said unattached upper edge thereof defines a straight line and said side and bottom edges define a continuous curved line.

3. A toy doll of claim 2 wherein said head portion is cloth covered and said side and bottom edges of said transparent film are sewn thereon.

4. The toy doll of claim 1 wherein said mass of hair-like material also conceals the side edges of said transparent film.

5. The toy doll of claim 4 further comprising a hat with a foldable brim disposed on said head portion, said brim being adapted for folding over said upper edge to cooperate with the portion of said hair-like material attached to said upper edge to conceal said slot, whereby a realistic appearance is provided to said doll without inhibiting photo insertion into said slot.

6. The toy doll of claim 5 wherein said transparent film is semi-oval and said unattached upper edge thereof defines a straight line and said side and bottom edges define a continuous curved line.

7. The toy doll of claim 6 wherein said head portion is cloth covered and said side and bottom edges of said transparent film are sewn thereon.

* * * * *